US007483012B2

(12) United States Patent
Yoo et al.

(10) Patent No.: US 7,483,012 B2
(45) Date of Patent: Jan. 27, 2009

(54) LCD HAVING INTEGRATED AMORPHOUS-SILICON TFT ROW DRIVER

(75) Inventors: Se Jong Yoo, Kyoungki-do (KR); Cheon Hong Kim, Seoul (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 502 days.

(21) Appl. No.: 10/746,031

(22) Filed: Dec. 24, 2003

(65) Prior Publication Data

US 2004/0183770 A1 Sep. 23, 2004

(30) Foreign Application Priority Data

Dec. 31, 2002 (KR) ..... 10-2002-008267

(51) Int. Cl.
*G09G 3/36* (2006.01)

(52) U.S. Cl. ..... 345/100; 345/204

(58) Field of Classification Search ..... 345/87, 345/204–206, 100

See application file for complete search history.

(56) References Cited

U.S. PATENT DOCUMENTS 5,517,542 A 5/1996 Huq
5,990,857 A * 11/1999 Kubota et al. ..... 345/98
6,396,560 B1 * 5/2002 Noguchi et al. ..... 349/187
6,928,135 B2 * 8/2005 Sasaki et al. ..... 377/64

FOREIGN PATENT DOCUMENTS

CN 1135625 11/1996

OTHER PUBLICATIONS

Chinese office action and English translation.

* cited by examiner

*Primary Examiner*—Richard Hjerpe
*Assistant Examiner*—Tom V Sheng
(74) *Attorney, Agent, or Firm*—Ladas & Parry LLP

(57) ABSTRACT

Disclosed is an LCD having an integrated amorphous-silicon TFT row driver. The LCD includes at least one shift register integrated in an LCD panel. The LCD uses a reset signal by shifting phase of gate drive pulse in a gate line direction according to a clock period. The LCD has a 1-bit shift register having a dummy function formed at a final terminal of the shift register. An input signal of drive pulse is used as the reset signal of a shift register formed at a final terminal of a shift register row.

1 Claim, 4 Drawing Sheets

LCD HAVING INTEGRATED AMORPHOUS-SILICON TFT ROW DRIVER

BACKGROUND OF THE INVENTION

1. Field of the invention

The present invention relates to an LCD having an integrated amorphous-silicon TFT row driver, and more particularly to an LCD having an integrated amorphous-silicon TFT row driver, in which a drive IC is replaced with a shift register integrated in an LCD panel.

2. Description of the Prior Art

Generally, a TFT-LCD includes a TFT, which is a switching device, a capacitor and an auxiliary capacitor, which are formed by liquid crystal filled between upper and lower electrodes, a gate electrode for managing on/off of the TFT, and an image signal electrode. A transistor is turned on when voltage is applied to a gate of the TFT forming pixels by means of external peripheral circuits so that image voltage can be applied to liquid crystal. After storing image information in liquid crystal by applying image voltage to liquid crystal, the transistor is turned off, so the charges stored in the liquid crystal capacitor and the auxiliary capacitor are preserved, thereby displaying an image for a predetermined time. When voltage is applied to liquid crystal, alignment of liquid crystal varies. In this state, if light passes through liquid crystal, diffraction may occur. Accordingly, desired images can be obtained by passing diffracted light through a polarizing plate.

However, the LCD uses a drive IC at a gate PCB so as to supply drive pulse to a gate line. Therefore, a pad section and a fan-out section are required in order to mount the drive IC, so that it is difficult to fabricate the LCD in a compact size. In addition, due to the drive IC, manufacturing cost and weight of the LCD are increased.

For this reason, as shown FIGS. 1 and 2, a COF (chip on film) type LCD, in which a PCB is removed from the LCD panel through a COF process, or an LCD having an integrated amorphous-silicon TFT row driver, in which the drive IC is replaced with a drive circuit integrated in the LCD panel, have been proposed in order to fabricate the LCD in a compact size and to reduce manufacturing cost and weight of the LCD.

In order to integrate the drive circuit in the LCD panel, a shift register is necessarily required for shifting a phase of gate drive pulse in a gate line direction according to a clock period. At this time, the drive circuit includes four transistors and two capacitances. In addition, rope potential is stabilized by means of a reset terminal.

However, according to the conventional technique, if a reset operation is not carried out at a final terminal of the LCD panel, signals are distorted as a gate drive period repeats, so the shift register is malfunctioned.

SUMMARY OF THE INVENTION

Accordingly, the present invention has been made to solve the above-mentioned problems occurring in the prior art, and an object of the present invention is to provide an LCD having an integrated amorphous-silicon TFT row driver, capable of solving a signal distortion problem by simultaneously performing a reset operation in both final terminal and previous terminal of a shift register.

In order to accomplish this object, there is provided an LCD having an integrated amorphous-silicon TFT row driver, the LCD including at least one shift register integrated in an LCD panel, the LCD using a reset signal by shifting phase of gate drive pulse in a gate line direction according to a clock period, the LCD comprising: a 1-bit shift register having a dummy function formed at a final terminal of the shift register.

According to another aspect of the present invention, there is provided an LCD having an integrated amorphous-silicon TFT row driver, the LCD including a shift register row integrated in an LCD panel, the LCD using a reset signal by shifting phase of gate drive pulse in a gate line direction according to a clock period, wherein an input signal of drive pulse is used as the reset signal of a shift register formed at a final terminal of the shift register row.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
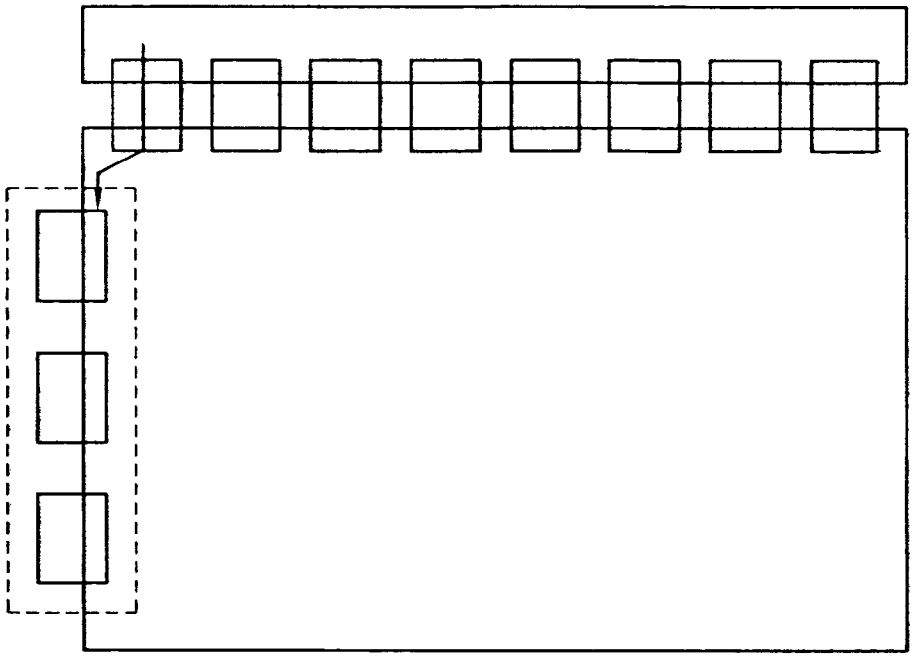
FIG. 1 (PRIOR ART)
FIG. 1 is a plan view showing a conventional COF type LCD panel.
Figure 2:
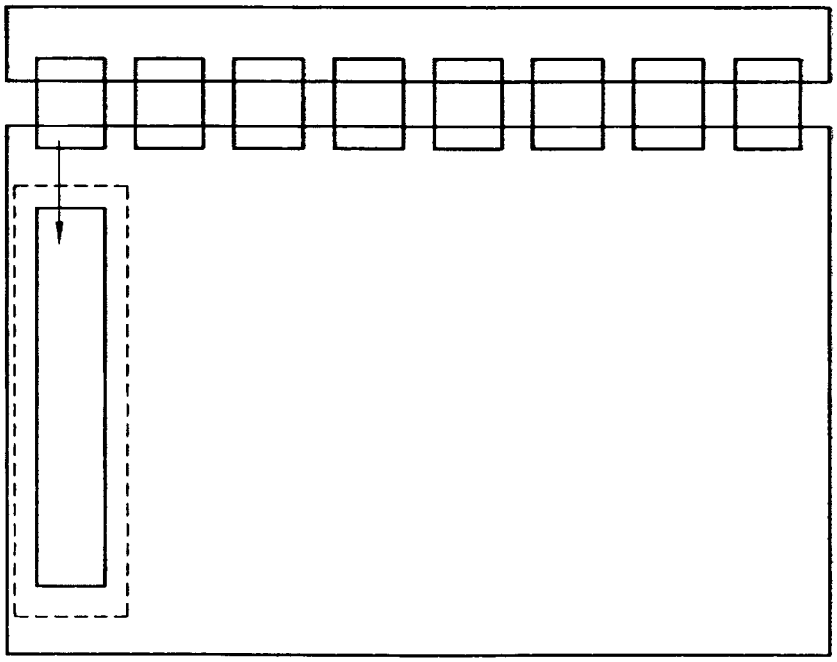
FIG. 2 (PRIOR ART)
FIG. 2 is a plan view showing a conventional LCD panel having an integrated amorphous-silicon TFT row driver.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
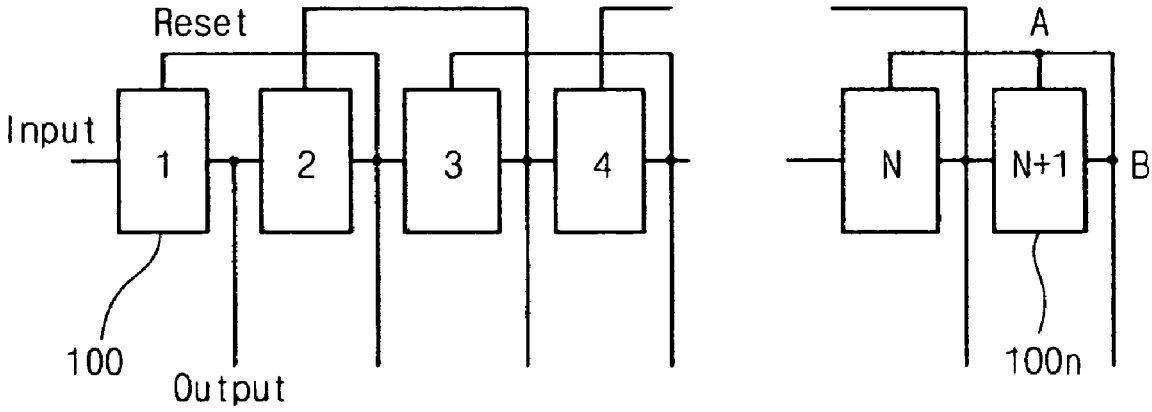
FIG. 3 is a schematic view showing an LCD having an integrated amorphous-silicon TFT row driver according to one embodiment of the present invention.

FIG. 3 is a schematic view showing an LCD having an integrated amorphous-silicon TFT row driver according to one embodiment of the present invention.

Figure 4A:
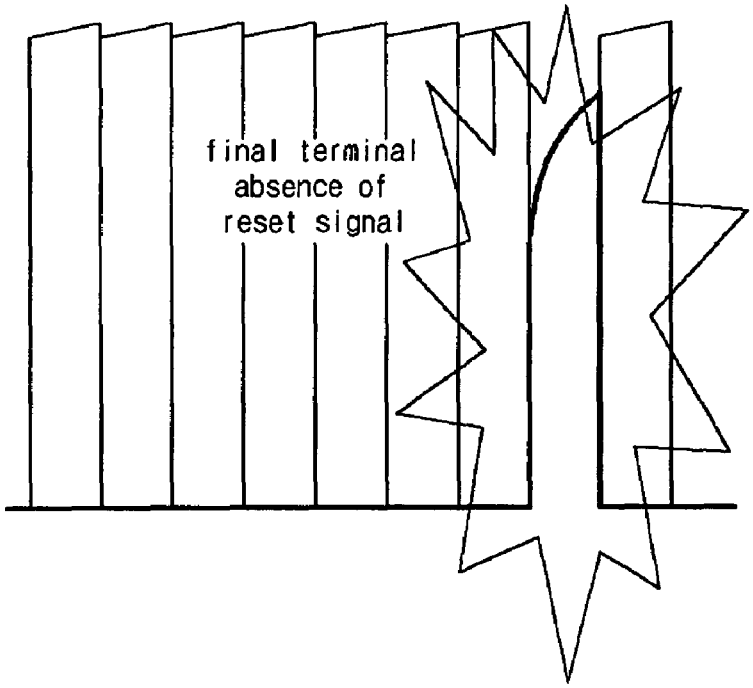
FIGS. 4*a* and 4*b* are views showing an output waveform according to a reset operation at a final terminal of a shift register shown in FIG. 3.
Figure 4B:
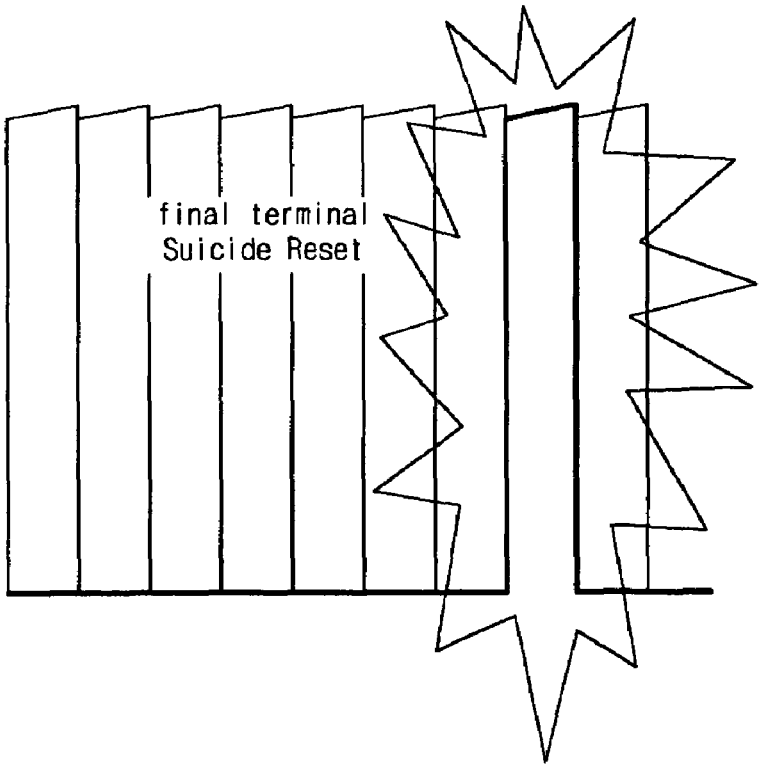

FIGS. 4*a* and 4*b* are views showing an output waveform according to a reset operation at a final terminal of a shift register shown in FIG. 3.

Figure 5:
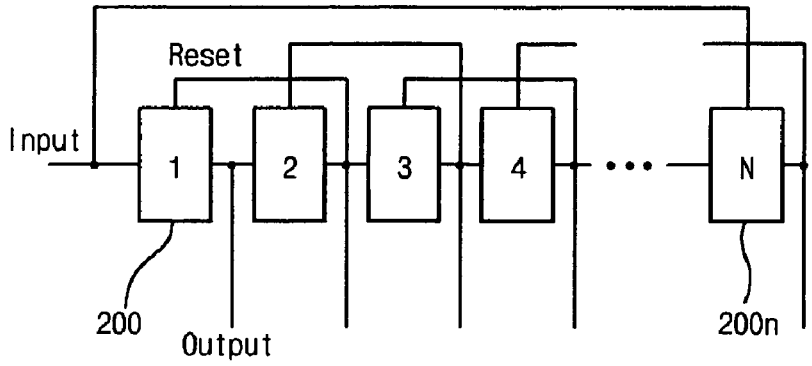
FIG. 5 is a schematic view showing an input signal used as a reset signal of a final terminal of a shift register row according to another embodiment of the present invention.

FIG. 5 is a schematic view showing an input signal used as a reset signal of a final terminal of a shift register row according to another embodiment of the present invention.

Figure 6:
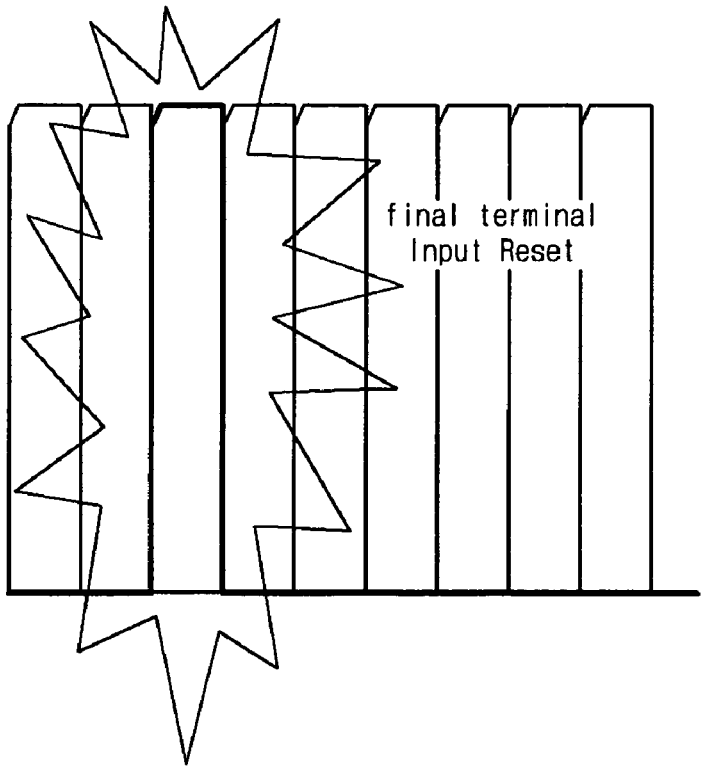
FIG. 6 is a view showing an output waveform at the final terminal of the shift register row shown in FIG. 5.

FIG. 6 is a view showing an output waveform at the final terminal of the shift register row shown in FIG. 5.

As shown in FIG. 3, the LCD having an integrated amorphous-silicon TFT row driver according to one embodiment of the present invention is achieved by further providing a 1-bit shift register 100*n* having a dummy function at a final terminal of a shift resister circuit integrated in the LCD panel.

In addition, an output B of the final shift register 100*n* is simultaneously connected to a previous shift resister 100*n*-1 and a reset terminal A of the final shift register 100*n*.

According to the LCD having the above construction, when drive pulse is supplied to a gate line, the final shift register 100*n* resets the previous shift register 100*n*-1 while performing a reset operation thereof, so that a signal distortion caused by an absence of a reset signal can be prevented.

That is, a width of an output TFT creating an output of the final shift register 100*m* is designed sufficiently larger than a width of a reset TFT, so that the final shift register performs the reset operation after applying the reset signal to the previous shifter register. It is understood from FIGS. 4*a* and 4*b* that the output waveform of FIG. 4*a*, in which the reset signal is not applied to the final terminal, is different from the output waveform of FIG. 4*b*, in which the reset signal is applied to the final terminal.

FIG. 5 schematically shows a shift register circuit, in which the input signal is used as the reset signal of the final terminal of the shift register row according to another embodiment of the present invention.

As shown in FIG. 5, according to another embodiment of the present invention, an input signal of drive pulse is used as a reset signal C of a shift register 200*n* of a final terminal.

That is, a start input signal of an initial gate pulse is inputted as the reset signal of the final terminal so as to reset the final terminal, so that output signals of the whole shift register are not distorted even if the period is repeated (referred to FIG. 6).

In addition, in order to achieve the reset operation by applying the input signal to the final reset terminal, the period of the input signal must be two times of clock pulse.

As described above, the LCD having the integrated amorphous-silicon TFT row driver according to the present invention has advantages as follows:

Firstly, the signal distortion can be prevented by adding the 1-bit shift register at the final terminal of the shift register circuit integrated in the LCD panel, so an additional reset wiring is not required, thereby fabricating the LCD panel in a compact size.

In addition, since the input reset signal is used as the reset signal for the final terminal, an additional reset signal is not required.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An LCD having an integrated amorphous-silicon TFT row driver, the LCD including at least one shift register row integrated in an LCD panel, the LCD using a reset signal by shifting the phase of a gate drive pulse in a gate line direction according to a clock period, the LCD comprising:

a 1-bit final shift register having a dummy function and operatively coupled to a final terminal of the shift register row;

wherein an output of said 1-bit final shift register is connected to both a previous shift register in said shift register row and a reset terminal of the 1-bit final shift register.

* * * * *